US008764941B2

(12) United States Patent
Heng et al.

(10) Patent No.: US 8,764,941 B2
(45) Date of Patent: Jul. 1, 2014

(54) BASE PAPER OF ARAMID FIBER HONEYCOMB CORE AND MANUFACTURING METHOD THEREOF

(75) Inventors: Peizhi Heng, Sichuan (CN); Wenyong Tang, Sichuan (CN); Shiyi Tao, Sichuan (CN); Liping Wang, Sichuan (CN)

(73) Assignee: Longpoint Co., Ltd., Nanshan, Shenzhen (CN)

( * ) Notice: Subject to any disclaimer, the term of this patent is extended or adjusted under 35 U.S.C. 154(b) by 95 days.

(21) Appl. No.: 13/055,293

(22) PCT Filed: Jul. 21, 2009

(86) PCT No.: PCT/CN2009/000813

§ 371 (c)(1), (2), (4) Date: Mar. 31, 2011

(87) PCT Pub. No.: WO2010/009613

PCT Pub. Date: Jan. 28, 2010

(65) Prior Publication Data

US 2011/0174452 A1 Jul. 21, 2011

(30) Foreign Application Priority Data

Jul. 22, 2008 (CN) ..... 2008 1 0068572

(51) Int. Cl.
*D21H 13/26* (2006.01)
*D21H 13/24* (2006.01)
*D21H 25/04* (2006.01)

(52) U.S. Cl.
CPC ..... *D21H 13/26* (2013.01); *D21H 13/24* (2013.01); *D21H 25/04* (2013.01)
USPC ..... 162/146; 162/206; 428/116

(58) Field of Classification Search
CPC ..... D21H 13/26; D21H 13/24; D21H 25/04; B32B 3/12
USPC ..... 162/141, 146, 149, 204–206; 428/116, 428/327; 442/415
See application file for complete search history.

(56) References Cited

U.S. PATENT DOCUMENTS

| | | | | |
|---|---|---|---|---|
| 3,756,908 | A * | 9/1973 | Gross | 162/146 |
| 4,729,921 | A * | 3/1988 | Tokarsky | 428/326 |
| 5,137,768 | A * | 8/1992 | Lin | 428/116 |
| 6,458,244 | B1 * | 10/2002 | Wang et al. | 162/146 |
| 6,544,622 | B1 * | 4/2003 | Nomoto | 428/116 |
| 6,551,456 | B2 * | 4/2003 | Wang et al. | 162/146 |
| 8,025,949 | B2 * | 9/2011 | Levit et al. | 428/116 |
| 8,118,975 | B2 * | 2/2012 | Levit et al. | 162/146 |
| 2002/0142689 | A1 * | 10/2002 | Levit | 442/381 |
| 2003/0051838 | A1 * | 3/2003 | Wang et al. | 162/146 |
| 2007/0009688 | A1 * | 1/2007 | Haque et al. | 428/34.1 |
| 2009/0159227 | A1 * | 6/2009 | Levit et al. | 162/146 |
| 2010/0047515 | A1 * | 2/2010 | Kehrle et al. | 428/116 |
| 2011/0174452 | A1 * | 7/2011 | Heng et al. | 162/146 |
| 2011/0244175 | A1 * | 10/2011 | Kehrle et al. | 428/116 |
| 2011/0244193 | A1 * | 10/2011 | Kehrle et al. | 428/175 |
| 2013/0309463 | A1 * | 11/2013 | Tao et al. | 428/209 |

FOREIGN PATENT DOCUMENTS

| | | | |
|---|---|---|---|
| CN | 1083883 | | 3/1994 |
| CN | 1364208 | | 8/2000 |
| CN | 1884692 | | 12/2006 |
| CN | 1932148 | | 3/2007 |
| CN | 101343845 | | 1/2009 |
| GB | 2347437 | A * | 9/2000 |
| JP | 11-21784 | | 1/1999 |
| JP | 2000220091 | A * | 8/2000 |
| WO | WO0043594 | A1 * | 7/2000 |
| WO | WO 0107713 | A1 * | 2/2001 |
| WO | WO 02072933 | A1 * | 9/2002 |
| WO | WO 2010009613 | A1 * | 1/2010 |

* cited by examiner

*Primary Examiner* — Jose Fortuna
(74) *Attorney, Agent, or Firm* — Greer, Burns & Crain, Ltd.

(57) ABSTRACT

A base paper of aramid fiber honeycomb core and its manufacturing method are provided. The base paper comprises 11-90 parts by weight of structural fiber, 10-70 parts by weight of crosslinking fiber, and 0-19 parts by weight of additive fiber, wherein the structural fiber is poly(p-phenylene terephthal amide) fiber, the crosslinking fiber is poly (m-phenylene isophthal amide) fibrid, and the additive is polyester fiber.

7 Claims, No Drawings

BASE PAPER OF ARAMID FIBER HONEYCOMB CORE AND MANUFACTURING METHOD THEREOF

FIELD OF THE INVENTION

The present invention relates to a synthetic fiber paper, particularly to a base paper of honeycomb core containing aramid fiber.

The present invention also relates to a method for manufacturing the base paper of aramid fiber honeycomb core.

BACKGROUND OF THE INVENTION

With the development of technology and the increasing market demands, high performance synthetic materials have been used since they have been invented in areas like aviation, aerospace, military, electronics, mechanical industry and other industries requiring safe and light materials. High performance synthetic material—aramid fiber paper—emerges at a historic moment and, has high strength, low deformability, resistance to high temperature, resistance to chemical corrosion, no fatigue reaction and excellent insulation property. Chinese Patent No. 99114635.2 discloses a synthetic fiber paper made of poly(p-phenylene terephthal amide) fibre (also named as aramid fiber 1414, Fanglun 1414 or PPTA) as main fiber and polyester fiber (polyethylene glycol terephthalate fiber) as crosslinking fiber, which has some advantages of high temperature resistance, high strength, low deformability and etc. However, the invention is not good enough in papermaking performance and finished paper performance. First, during the papermaking of the paper blank, the strength of the paper blank is poor and the defective index of the papermaking is high. Second, after hot rolling, the paper sheets have insufficient density (tightness), high porosity and high permeability, and the penetration of glue stuff is difficult to control while manufacturing honeycomb board. Third, the hot strength retention of the honeycomb paperboard is not good enough.

Chinese patent application CN1570271 discloses a synthetic paper containing carbon fiber and aramid fiber and a wet papermaking process, wherein carbon fibre and aramid fiber are used as structural fiber, and polyester or polyphenyl thioether fiber is used as crosslinking fiber. Due to the presence of carbon fiber, this synthetic fiber paper tends to be used with respect to heat transmission and electric conduction, and its electric insulation and heat insulation properties are not good enough.

Both Chinese patent application No. 2006100633513.2 entitled SYNTHETIC FIBER PAPER CONTAINING BASALT FIBER AND ARAMID FIBRE AND PREPARATION METHOD THEREOF and Chinese patent application No. 200610063595.0 entitled SYNTHETIC FIBER PAPER CONTAINING POLYPHENYL THIOETHER AND CHEMICAL FIBER AND PREPARATION METHOD THEREOF disclose a method of preparing synthetic aramid fiber paper using polyphenyl thioether fiber as crosslinking fiber, wherein only aramid fiber is used as stuffing material, and the resultant paper sheets are confronted with high porosity and excessive permeability.

In the above-mentioned processes for preparing synthetic paper using aramid fiber 1414, a hot melt fiber such as polyester or polyphenyl thioether is used as crosslinking fiber. This produces an effect of point bonding, resulting in many cavities among the fibers, loose structure of the paper sheets, and unmanageable penetration of the resin while manufacturing honeycomb board. Moreover, when a high amount of polyester is used, the hot strength retention of the honeycomb board fails to reach a desired result.

SUMMARY OF THE INVENTION

An object of the present invention is to provide a new synthetic fiber paper (base paper of honeycomb core), which is obtained by mixing and papermaking para-aramid fiber (aramid fiber 1414) and meta-aramid fibrid (fibrid of aramid fiber 1313), and if necessary, adding a small amount of polyester fiber.

In the paper making of paper blank of para-aramid fiber, the addition of meta-aramid fibrid and the addition of a small amount of polyester fiber greatly improve the papermaking performance and finished paper performance, meeting the process requirements of manufacturing the honeycomb board. In addition, the paper made according to such process requirements has better insulation property and can be used in insulating composite materials. At present, this process of preparing synthetic fiber paper has not been reported at home and abroad.

In the fiber paper of the present invention, para-aramid fiber (1414 fiber) is used as structural fiber, meta-aramid fiber (fibrid) is used as crosslinking fiber, and polyester fiber is only used as additive fiber. The amount of polyester fiber is substantially reduced, thus greatly improving the papermaking performance and finished paper performance, especially the porosity of the finished paper, and enhancing the temperature resistance of the paper, meeting the process requirements of manufacturing aramid fiber honeycomb core. Preferably, the amount of structural fiber is 11~90 parts by weight, the amount of crosslinking fiber is 10~70 parts by weight, and the amount of additive fiber is 0~19 parts by weight.

In a preferred embodiment, the structural fiber is poly(p-phenylene terephthalamide) fiber (aramid fiber 1414), which is 1~2 d in size and 0.05~10 mm in length; the crosslinking fiber is poly(m-phenylene isophthalamide) fibrid, which is slight, irregular fibrous or film-like shives, and has two dimensions in the micron range of the three-dimensional size; the additive fiber is polyester fiber, which has a softening point of 238~240° C., melting point of 255~260° C., a size of 1~2 d and a length of 0.5~7 mm.

Poly(m-phenylene isophthalamide) fibrid as the crosslinking fiber is prepared by feeding poly(m-benzenedicarboxamide) solution with a certain viscosity (1.6~1.9) into a precipitation machine respectively. Said solution comprises water and calcium chloride besides poly(m-benzenedicarboxamide). The polymer is precipitated by using a controllable setting composition. The rotor speed of the precipitation machine is 6000~7000 rpm. This high speed running produces a shearing force for obtaining good quality fibrid that is suitable for papermaking, precipitating two-dimensional finely pellicular fibrid. Finally, the fibrid is washed with water and refined by beating to obtain fibrid pulp. Beating loosens and dissociates the intertwined fibers and increases the specific surface of the fibrid, and further enhances the hydrogen bonding between the fibers. The quality of the obtained fibrid will have a direct impact on the mechanical strength of the synthetic paper. Addition of the fibrid pulp to a synthetic paper pulp will give the synthetic paper pulp a finished paper performance, similar to that of a plant paper pulp, and will allow the non-hot rolled paper blank to have a higher initial strength. Moreover, during the following hot rolling, the strength of the fibrid is further enhanced under high temperature and high pressure. The beating degree of the present invention is 25~55° SR. The fibrid is also available through direct commercial purchase.

Another object of the present invention is to provide a method for preparing base paper of honeycomb core of the present invention. The paper of the present invention can be prepared by conventional papermaking methods and equipments. Preparing the paper of the present invention entails adding short aramid fiber 1414 and polyester fiber into water, subject to be loosened and dissociated to obtain slurry A, beating m-aramid fibrid to obtain slurry B, mixing slurry A and slurry B to form a paper pulp, papermaking the paper pulp using paper machine, and distributing the pulp liquid in a flow box uniformly on a paper forming wire. When the pulp liquid runs along the forming wire, water is removed from the paper pulp to form a wet paper blank, allowing the wet paper blank to leave the forming wire and enter a dryer section of the paper machine. The purpose of drying is to remove water without destruction or damage to the paper sheets. Drying is performed by contacting the wet paper sheets with the surface of a steam cylinder. The dried paper sheets is subjected to high temperature hot rolling by a hot rolling machine, and then subjected to surface finishing by a calendering machine, finally obtaining the base paper of aramid fiber honeycomb core.

Another aspect of the present invention relates to a hot rolling process after adding fibrid and polyester fiber. The present invention employs a dual temperature dual pressure zone to roll the paper sheets. In a first group, the linear pressure of hot rolling is 0~100 kg/cm, the surface temperature of roller is 240~255° C., and the rolling speed is 3~30 m/min; in a second group, the linear pressure hot rolling is 30~200 kg/cm, the surface temperature of the roller is 180~240° C., and the rolling speed is 3~30 m/min. Wherein the highest temperature of hot rolling should be controlled between the softening point and the melting point of the polyester fiber. Hot rolling is quite an important segment in the production of aramid fiber paper. The aramid paper prepared by wet forming process goes through a hot rolling machine and is added to a paper surface containing fibrid under high temperature and high pressure, thus resulting in some melting and viscosity under the high pressure. The aramid paper is subjected to hot-rolling setting, thereby allowing the paper sheets have higher physical and electrical properties.

The hot rolled paper is then subjected to finishing by calender, keeping the temperature at 0~250° C. Calendering finishing of the aramid fiber paper, similar to that of plant fiber paper, can distinctly improve the smoothness, glossiness, and density of the paper, particularly the thickness uniformity of the paper. The finishing process can be adjusted depending on the type of the paper. Generally speaking, as the calendering pressure increases, the thickness, porosity, porocity and tearing strength of the paper decrease, while the smoothness, glossiness, density and elongation rate increase. In addition, while the thickness of the paper decreases and the thickness uniformity improves, the insulation strength of the paper also increases.

DETAILED DESCRIPTION OF THE INVENTION

The above is the general description of the present invention, and the following embodiments are used to further illustrate the claim of the present invention.

Materials and their sources:

poly(p-phenylene terephthalamide) fiber (para-aramid fiber, or aramid fiber 1414): Teijin Ltd. (Japan)

poly(m-phenylene isophthal amide) fibrid (meta-aramid fibrid, or aramid 1313 fibrid): Guangdong Charming Co. Ltd. (China)

polyester fiber (Poly(p-phenylene terephthal amide glycol ester) fiber): Hebei Baoding Polyester Factory (China)

Example 1

The synthetic fiber paper of example 1 was prepared according to the following proportion.

| | |
|---|---|
| para-aramid fiber (5~6 mm) | 65 parts by weight (hereafter called "parts") |
| meta-aramid fibrid | 20 parts |
| polyester fiber (2~4 mm) | 15 parts |

The amounts of the above para-aramid fiber and polyester fiber were loosened and dissociated at a concentration of 1% by weight in a hydraulic fluffer to make slurry A. The meta-aramid fibrid was beaten at a concentration of 2% by beater, keeping the beating degree at about 55° SR, to make slurry B. Slurry A and slurry B were mixed uniformly in a mixing chamber to form a paper pulp that can be added to a head box. 5 parts of polyethylene oxide were added to a steady slurry box. Pressure head of the pulp liquid was adjusted via the steady slurry box. The pulp liquid in flow box was distributed on a forming wire for papermaking, and the excessive pulp overflowed into a white water chest. While the pulp ran along the forming wire, water was filtrated out in virtue of the couch roll. Wet paper sheets were allowed to leave the wire side, and the wet paper sheets were placed on a woven felt, and further subjected to dehydration by vacuum box and wet pressing, and then put into the drying section of the paper machine. Subsequently, the paper sheets were subjected to compound hot rolling by hot rolling machine. The hot rolling is used in paper rolling via a dual temperature dual pressure zone process, wherein in a first group, the linear pressure of hot rolling is 25 kg/cm, the surface temperature of the roller is 250° C., and the rolling speed is 15 m/min; in a second group, the linear pressure of hot rolling is 130 kg/cm, the surface temperature of the roller is 220° C., and the rolling speed is 15 m/min. The hot rolled paper is then subjected to finishing by calendar, controlling the temperature at 180° C. The results are shown in table 1.

TABLE 1

Physical, mechanical properties of the fiber paper

| Item | Unit | Test result |
|---|---|---|
| Basis weight | $g/m^2$ | 47.2 |
| Thickness | mm | 0.058 |
| Tensile strength | KN/m MD | 3.58 |
| Elongation rate | % MD | 2.6 |
| Time of penetration | S | 18.2 |
| Surface absorbency | % | 22.3 |

Example 2

The synthetic fiber paper of example 2 was prepared according to following proportion.

| | |
|---|---|
| para-aramid fiber (5~6 mm) | 61 parts |
| meta-aramid fibrid | 20 parts |
| polyester fiber (2~4 mm) | 19 parts |

The amounts of para-aramid fiber and the meta-aramid fibrid, and the amount of polyester were adjusted in this example. The preparation method of the fiber paper is the same as that of example 1. The results are shown in table 2.

TABLE 2

| Physical, mechanical properties of the fiber paper | | |
|---|---|---|
| Item | Unit | Test result |
| Basis weight | $g/m^2$ | 46.8 |
| Thickness | mm | 0.061 |
| Tensile strength | KN/m MD | 3.91 |
| Elongation rate | % MD | 2.25 |
| Time of penetration | S | 15.4 |
| Surface absorbency | % | 22.6 |

Example 3

The fiber paper of example 3 was prepared according to following proportion.

| | |
|---|---|
| para-aramid fiber (5~6 mm) | 85 parts |
| meta-aramid fibrid | 15 parts |

The amounts of para-aramid fiber and meta-aramid fibrid were adjusted in this example. The preparation method of the fiber paper is the same as that of example 1. The results are shown in table 3.

TABLE 3

| Physical, mechanical properties of the fiber paper | | |
|---|---|---|
| Item | Unit | Test result |
| Basis weight | $g/m^2$ | 45.8 |
| Thickness | mm | 0.057 |
| Tensile strength | KN/m MD | 1.6 |
| Elongation rate | % MD | 2.01 |
| Time of penetration | S | 14.4 |
| Surface absorbency | % | 24.6 |

Example 4

The fiber paper of example 4 was prepared according to following proportion.

| | |
|---|---|
| para-aramid fiber (5~6 mm) | 30 parts |
| meta-aramid fibrid | 70 parts |

The amounts of para-aramid fiber and meta-aramid fibrid were adjusted in this example. The preparation method of the fiber paper is the same as that of example 1. The results are shown in table 4.

TABLE 4

| Physical, mechanical properties of the fiber paper | | |
|---|---|---|
| Item | Unit | Test result |
| Basis weight | $g/m^2$ | 46.4 |
| Thickness | mm | 0.052 |
| Tensile strength | KN/m MD | 2.03 |
| Elongation rate | % MD | 1.81 |
| Time of penetration | S | 25.4 |
| Surface absorbency | % | 16.9 |

Example 5

The fiber paper of example 5 was prepared according to following proportion.

| | |
|---|---|
| para-aramid fiber (5~6 mm) | 50 parts |
| meta-aramid fibrid | 50 parts |

The amounts of para-aramid fiber and meta-aramid fibrid were further adjusted in this example. The preparation method of the fiber paper is the same as that of example 1. The results are shown in table 5.

TABLE 5

| Physical, mechanical properties of the fiber paper | | |
|---|---|---|
| Item | Unit | Test result |
| Basis weight | $g/m^2$ | 45.6 |
| Thickness | mm | 0.059 |
| Tensile strength | KN/m MD | 2.8 |
| Elongation rate | % MD | 2.4 |
| Time of penetration | S | 20.5 |
| Surface absorbency | % | 18.8 |

Example 6

The fiber paper of example 6 was prepared according to following proportion.

| | |
|---|---|
| para-aramid fiber (5~6 mm) | 65 parts |
| polyester fiber (2~4 mm) | 35 parts |

This example employed polyester fiber as crosslinking fiber. The papermaking method of the fiber paper blank is the same as that of example 1, except that the hot rolling temperature was adjusted to 260~265° C., and the paper was subjected to hot rolling shaping once. The results are shown in table 6.

TABLE 6

| Physical, mechanical properties of the fiber paper | | |
|---|---|---|
| Item | Unit | Test result |
| Basis weight | $g/m^2$ | 46.2 |
| Thickness | mm | 0.069 |
| Tensile strength | KN/m MD | 4.51 |
| Elongation rate | % MD | 2.47 |
| Time of penetration | S | 7.6 |
| Surface absorbency | % | 28.9 |

INDUSTRIAL APPLICABILITY

The synthetic fiber paper has the advantages of light weight, tenderness, high specific strength, high specific modulus, high temperature resistance, fatigue resistance, chemical corrosion resistance, low coefficient of thermal expansion, and moderate permeability. In the manufacture of honeycomb core, the honeycomb core base paper has an excellent effect on impregnating resins and binding to the honeycomb junctions, and the resultant honeycomb board has very high plane shear modulus and plane compressive strength.

The present invention is not limited to the above embodiments. According to the dependent relationship between proportion, parameters of the hot rolling process and the physical, mechanical strength indexes of the fiber paper, those skilled in the art can produce products with various models and specifications to meet the special requirements of users. It will be appreciated by those skilled in the art that changes and modifications may be made thereto without departing from the invention and as set forth in the following claims.

What is claimed is:

1. A base paper of aramid fiber honeycomb core, comprising:

structural fiber;

crosslinking fiber; and additive fiber;

wherein said structural fiber is poly(p-phenylene terephthal amide) fiber at 65 parts by weight, said crosslinking fiber is poly(m-phenylene isophthal amide) fibrid at 20 parts by weight, and said additive fiber is polyester fiber is poly(ethylene glycol terephthalate) fiber at 15 parts by weight;

wherein said base paper of aramid fiber honeycomb core is prepared by subjecting to papermaking shaping of structural fiber, crosslinking fiber and additive fiber via wet papermaking, and hot rolling; and wherein said hot rolling is dual temperature dual pressure zone hot rolling, in a first group, the linear pressure of hot rolling is 0~100 kg/cm, the surface temperature of the roller is 240~255° C., the rolling speed is 3~30 m/min; in a second group, the linear pressure of hot rolling is 30~250 kg/cm, the surface temperature of the roller is 180~230° C., the rolling speed is 3~30 m/min.

2. The base paper of aramid fiber honeycomb core of claim 1, wherein said poly(p-phenylene terephthal amide) fiber has a size of 1~2 d and a length of 0.05~10 mm.

3. The base paper of aramid fiber honeycomb core of claim 2, wherein said polyester fiber is polyethylene glycol terephthalate fiber, having a softening point of 238~240° C., a melting point of 255~260° C., a size of 1~2 d and a length of 0.5~7 mm.

4. A base paper of aramid fiber honeycomb core, comprising:

structural fiber;

crosslinking fiber; and additive fiber, wherein said structural fiber is poly(p-phenylene terephthal amide) fiber at 65 parts by weight, said crosslinking fiber is poly(m-phenylene isophthal amide) fibrid at 20 parts by weight, and said additive fiber is poly(ethylene glycol terephthalate) fiber at 15 parts by weight, wherein said base paper of aramid fiber honeycomb core is prepared by a dual temperature dual pressure zone hot rolling, wherein in a first group, the linear pressure of hot rolling is 0~100 kg/cm, the surface temperature of the roller is 240~255° C., the rolling speed is 3~30 m/min; and in a second group, the linear pressure of hot rolling is 30~250 kg/cm, the surface temperature of the roller is 180~230° C., the rolling speed is 3~30 m/min, and wherein said base paper of aramid fiber honeycomb core is subjected to a finishing process including calendaring at 180° C.

5. A method of preparing a base paper of aramid fiber honeycomb core comprising the following steps:

(a) adding a structural fiber of poly(p-phenylene terephthal amide) fiber at 65 parts by weight and a polyester fiber of poly(ethylene glycol terephthalate) fiber at 15 parts by weight in water, and loosening and dissociating the fibers to obtain slurry A;

(b) beating a crosslinking fiber of poly(m-phenylene isophthal amide) fibrid at 20 parts by weight to obtain slurry B;

(c) mixing slurry A and slurry B to form a paper pulp;

(d) forming a paper by papermaking shaping and drying said paper pulp;

(e) hot rolling said paper, wherein said hot rolling is dual temperature dual pressure zone hot rolling, in a first group, the linear pressure of hot rolling is 0~100 kg/cm, the surface temperature of the roller is 240~255° C., the rolling speed is 3~30 m/min; and in a second group, the linear pressure of hot rolling is 30~250 kg/cm, the surface temperature of the roller is 180~230° C., the rolling speed is 3~30 m/min; and (f) calendaring finishing said paper.

6. The method of claim 5, wherein said poly(m-phenylene isophthal amide) fibrid in step (b) has a beating degree of 25~55° SR.

7. The method of claim 5, further comprising a step of setting the temperature during calendering finishing at 0~250° C.

* * * * *